US009903088B2

(12) United States Patent
MacDonald et al.

(10) Patent No.: US 9,903,088 B2
(45) Date of Patent: Feb. 27, 2018

(54) BLOCKS AND BLOCK CONNECTORS, BLOCK SYSTEMS AND METHODS OF MAKING BLOCKS

(71) Applicants: Robert A. MacDonald, Plymouth, MN (US); Thomas S. Riccobene, Albuquerque, NM (US)

(72) Inventors: Robert A. MacDonald, Plymouth, MN (US); Thomas S. Riccobene, Albuquerque, NM (US)

(73) Assignee: KEYSTONE RETAINING WALL SYSTEMS LLC, West Chester, OH (US)

( * ) Notice: Subject to any disclaimer, the term of this patent is extended or adjusted under 35 U.S.C. 154(b) by 0 days.

(21) Appl. No.: 15/045,795

(22) Filed: Feb. 17, 2016

(65) Prior Publication Data

US 2016/0237638 A1 Aug. 18, 2016

Related U.S. Application Data

(60) Provisional application No. 62/117,544, filed on Feb. 18, 2015.

(51) Int. Cl.
*E02D 29/02* (2006.01)
*E04C 1/00* (2006.01)

(52) U.S. Cl.
CPC ..... *E02D 29/025* (2013.01); *E02D 29/0266* (2013.01); *E04C 1/00* (2013.01)

(58) Field of Classification Search
CPC ..... E02D 29/025; E02D 29/0266; E02D 29/0241; E02D 29/02; E04C 1/00; E04C 2/38; E04B 2002/0245; E04B 2/02; E04B 2/08; E04B 2002/0202; E04B 2002/0243
See application file for complete search history.

(56) References Cited

U.S. PATENT DOCUMENTS

| | | | |
|---|---|---|---|
| 3,295,287 | A | 1/1967 | Pasquale |
| 4,920,712 | A | 5/1990 | Dean, Jr. |
| 4,998,397 | A | 3/1991 | Orton |
| 5,248,226 | A | 9/1993 | Risi et al. |
| 5,735,643 | A | 4/1998 | Castonguay et al. |
| 6,115,983 | A | 9/2000 | Poignard |
| 6,701,687 | B1 | 3/2004 | Shillingburg |
| 2002/0001509 | A1 | 1/2002 | Hong |

FOREIGN PATENT DOCUMENTS

| | | |
|---|---|---|
| CA | 2 213 705 A1 | 8/1996 |

OTHER PUBLICATIONS

Jun. 8, 2016 PCT Notification of Transmittal of the International Search Report and the Written Opinion for International Application No. PCT/US2016/018313 (11 pages).

*Primary Examiner* — Carib Oquendo
(74) *Attorney, Agent, or Firm* — Popovich, Wiles & O'Connell, P.A.

(57) ABSTRACT

A retaining wall block and a setback connector for use in forming retaining walls having a desired setback between adjacent courses of blocks in a retaining wall. The method of constructing a retaining wall with a plurality of the blocks and setback connectors.

17 Claims, 14 Drawing Sheets

BLOCKS AND BLOCK CONNECTORS, BLOCK SYSTEMS AND METHODS OF MAKING BLOCKS

FIELD OF THE INVENTION

This invention relates generally to a retaining wall blocks and connectors for use in forming retaining walls having a desired setback or having no setback between adjacent courses of blocks in the retaining wall. This invention also relates to the method of constructing a retaining wall with a plurality of the blocks and connectors.

BACKGROUND OF THE INVENTION

Retaining walls are used in various landscaping projects and are available in a wide variety of styles. The blocks used to form retaining walls come in a wide variety of sizes and shapes. The front face of the blocks may be provided with a texture or a desired geometrical shape that provides the finished wall with a desired appearance. Typically, the blocks are provided as modular units that are dry stacked without the use of mortar when constructing the retaining wall.

When constructing the retaining wall the blocks are laid in courses until a desired wall height is obtained. Typically, the height of a retaining wall determines its stability. Short retaining walls having a height of about 3 feet or less are usually stable and may not require connection between courses of blocks or a setback between courses. If the height of the retaining wall is more than about 3 feet, the retained earth creates pressures on the backside of the retaining wall that may require adjacent courses of the wall to be connected or stabilized with respect to each other and may require the wall to be built with a desired setback. Therefore, it would be desirable to provide a block system that includes a block and an easy to use connector for use in connecting blocks in adjacent courses of a retaining wall at a desired setback.

SUMMARY OF THE INVENTION

Disclosed herein are various wall blocks and connectors which can be combined as a block system used to construct a block wall having a desired setback from block course to block course. Some of the connector embodiments disclosed herein may be used in a first orientation resulting in a setback between block courses and in a second orientation resulting in no setback between block courses in situations where no setback is required. Also disclosed herein are methods of constructing walls from the blocks and connectors. The invention described herein is intended to include all of the features of the blocks, connectors, block systems and methods which, either alone or in combination, patentably distinguish over the prior art. The invention is not intended to be limited to the particular size and shape of the blocks and connectors or to the order of steps disclosed herein unless the specification explicitly requires such limitation. Further, the concepts and features disclosed herein are equally applicable to blocks that are formed from a dry cast process or a wet cast process. As used herein the terms "the invention", "the present invention" or "this invention" are intended to refer in a broad manner to all of the subject matter described herein and is not to be limited to the particular embodiments disclosed. Additionally, the following summary is intended only as a broad overview and is not intended to identify critical features of the inventions disclosed herein.

A wall block system for constructing a wall from a plurality of wall blocks stacked in at least an upper course of wall blocks and a lower course of wall blocks. The wall block system includes a wall block having a block body with opposed front and rear faces, opposed first and second side walls, and opposed and substantially parallel top and bottom planar surfaces. The block body has a depth defined by a distance between the front and rear faces. The rear face of the wall block has an indentation extending into the block body a distance less than the depth of the block body. The wall block system may further include a block connector having upper, intermediate and lower portions. The upper portion is sized to be received within the indentation in the rear face of the wall block. The intermediate portion extends between the upper and lower portions and has a length at least as great as a distance between the indentation in the rear face of the wall block and the bottom planar surface of the wall block. The lower portion is sized to extend below the bottom planar surface of the wall block when the upper portion is received in the indentation such that, in a constructed wall, when the wall block is stacked in the upper course of blocks the lower portion of the block connector abuts against the rear face of an adjacent wall block in the lower course of blocks in the wall.

The upper portion of the connector may include a first member extending from the intermediate portion in a first direction and a second member extending from the intermediate portion in a second direction different from the first direction, the first and second members each being sized to be received within the indentation. The lower portion of the connector may include a projection extending from the intermediate portion in the first direction, the connector being positioned in a first orientation when the first member is received within the indentation and in a second orientation when the second member is received within the indentation, such that, in a constructed wall, the upper course of blocks is setback from the lower course of blocks by a distance equal to the length of the projection when the connector is positioned in the first orientation and the upper course of blocks has a zero setback with respect to the lower course of blocks when the connector is positioned in the second orientation.

The indentation may comprise a horizontal channel and/or a hole that may be cylindrical in shape or may have another shape. The upper portion of the connector may include a plurality of fins sized to be deformed when the upper portion is received in the indentation to provide a friction fit to secure the connector to the wall block.

In another embodiment the invention is a wall block system for constructing a wall from a plurality of wall blocks stacked in at least an upper course of wall blocks and a lower course of wall blocks. The wall block system may include a wall block having a block body with opposed front and rear faces, opposed first and second side walls, and opposed and substantially parallel top and bottom planar surfaces. The block body has a width defined by a distance between the first and second side walls. The first side wall may include an indentation having a first section extending into the block body toward the second side wall a first depth and a second section extending into the block body toward the second side wall a second depth greater than the first depth, the second depth being less than the depth of the block body. The second side wall includes an indentation having a first section extending into the block body toward the first side wall a first depth and a second section extending into the block body toward the first side wall a second depth greater than the first depth, the second depth being less than the depth of the block body. The wall block system may also include a block connector having upper, lower and extending portions. The upper portion being sized to be received in the first section of the indentation of one of the first and second side walls and the extending portion being sized to be received in the second section of the indentation. The lower portion being sized to extend below the bottom planar surface of the wall block when the upper portion is received in the first section of the indentation and the extending portion is received in the second portion of the indentation such that, in a constructed wall, when the wall block is stacked in the upper course of blocks the lower portion of the block connector abuts against the rear face of an adjacent wall block in the lower course of blocks in the wall.

The second section of the indentation may comprise a shape which is one of cylindrical, rectangular, triangular and square. The first section of the indentation of the first and second side walls may open onto the rear face of the wall block. The upper portion of the connector may include a plurality of fins sized to be deformed when the upper portion is received in the second section of the indentation to provide a friction fit to secure the connector to the wall block.

In one embodiment the invention is a method for constructing a wall from a wall block system which includes a plurality of wall blocks having a rear face including an indentation extending into the body of the wall blocks and block connectors having upper, intermediate and lower portions. The method includes positioning a first plurality of the wall blocks to form at least a portion of a first course of the wall and attaching at least one connector to each of a second plurality of wall blocks such that the upper portion of the at least one connector is received in the indentation in the rear face of the wall block. The intermediate portion of the connector extends along the rear face of the wall block between the indentation and a bottom surface of the wall block, and the lower portion of the connector extends below the bottom surface of the wall block. The method further includes stacking the second plurality of wall blocks on the first plurality of wall blocks to form at least a portion of a second course of the wall, the lower portion of the at least one connector attached to each of the second plurality of wall blocks abutting a rear face of at least one of the blocks in the first course to thereby prevent forward movement of the second plurality of wall blocks with respect to the first course of the wall.

In another embodiment the invention is a method for constructing a wall from a wall block system which includes a plurality of wall blocks having opposed first and second side walls, the first side wall including an indentation having a first section extending into the block body toward the second side wall a first depth and a second section extending into the block body toward the second side wall a second depth greater than the first depth, the second side wall including an indentation having a first section extending into the block body toward the first side wall a first depth and a second section extending into the block body toward the first side wall a second depth greater than the first depth, and block connectors having upper, lower and extending portions. The method includes positioning a first plurality of the wall blocks to form at least a portion of a first course of the wall and inserting a connector in each side wall indentation of a second plurality of wall blocks such that the upper portion of the at least one connector is received in the first section of the indentation and the extending portion is received in the second section of the indentation and such that lower portion of the connector extends below the bottom surface of the wall block. The method further includes stacking the second plurality of wall blocks on the first plurality of wall blocks to form at least a portion of a second course of the wall, the lower portions of each of the connectors attached to each of the second plurality of wall blocks abutting a rear face of at least one of the blocks in the first course to thereby prevent forward movement of the second plurality of wall blocks with respect to the first course of the wall.

BRIEF DESCRIPTION OF THE DRAWINGS

The various embodiments of the present invention will now be described by way of example with reference to the accompanying drawings, wherein.

DETAILED DESCRIPTION OF THE PREFERRED EMBODIMENTS

In this application, the term "block" refers to any block of any shape or style that can be used in the construction of block walls including retaining walls. Therefore, although all of the block embodiments described herein are directed to wall blocks having a particular shape or configuration it should be understood that the inventive concepts included herein apply to all types of blocks formed by any known process and are not limited to the wall blocks described herein.

In forming a wall, one row of blocks is laid down, forming a course. A second course is laid or stacked on top of this first course by positioning the lower surface of one block on the upper surface of another block or blocks in the lower course. It should be understood that lower surface and upper surface may refer to either the top surface or bottom surface of the block such that whichever surface is facing downward becomes the lower surface and whichever surface is facing upward becomes the upper surface.

Disclosed herein are multiple embodiments of wall blocks and connectors which, when combined form a wall block system which can be used to construct walls, including retaining walls. Each of the wall block systems disclosed herein includes a wall block and block connector configured for use with the wall block. As will be apparent, some of the block connectors disclosed herein can be used with more than one block embodiment. Further, some of the features disclosed in connection with one block embodiment or one connector embodiment can be incorporated into other block or connector embodiments disclosed herein.

Figure 1:
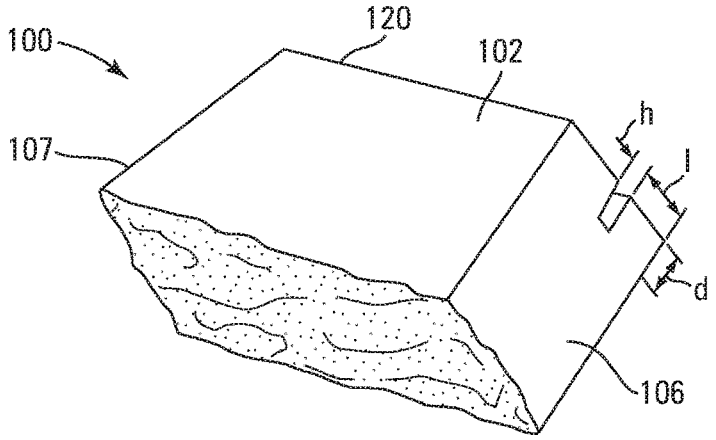
FIGS. 1 to 3 are front perspective, back and top views, respectively, of a first block embodiment in accordance with the present invention.
Figure 2:
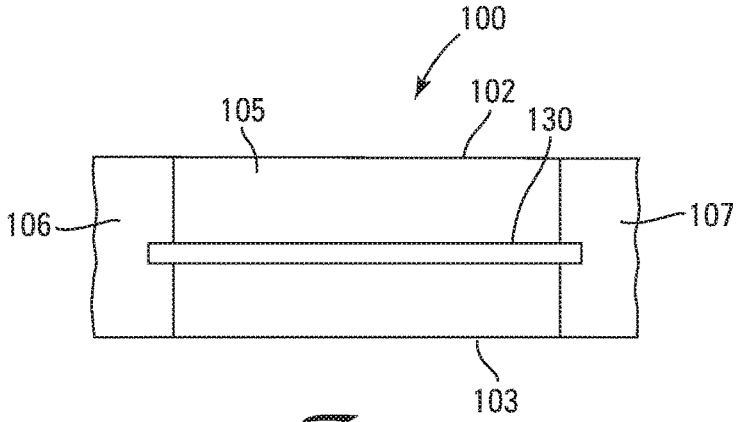
Figure 3:
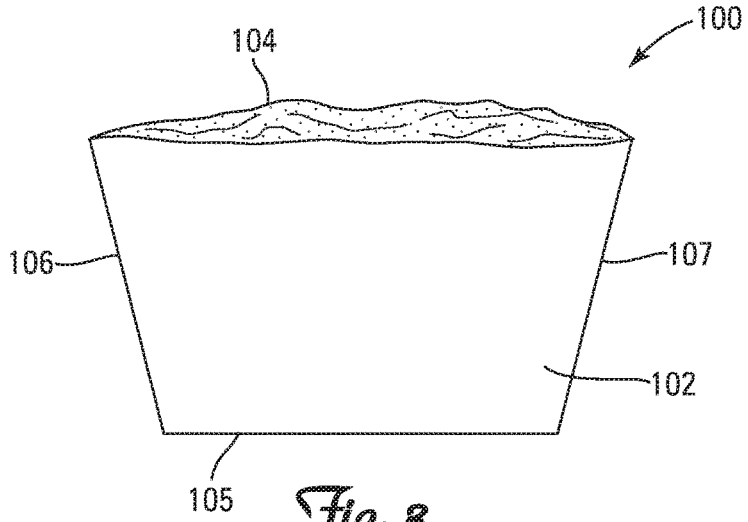

A first embodiment of the wall block is shown in FIGS. 1 to 3, which are front perspective, back and top views of block 100, respectively. Block 100 has a block body 120 having parallel top and bottom surfaces 102 and 103, respectively, front face 104, and rear face 105. Both front face 104 and rear face 105 extend from top surface 102 to bottom surface 103.

Rear face 105 of block 100 is provided with an indentation for receiving a mating block connector. In this embodiment the indentation has the shape of a receiving channel 130 which is sized and shaped to receive an upper portion of one or more block connectors as described in more detail hereafter. In this embodiment, channel 130 extends from side wall 106 to side wall 107, is substantially parallel to the top and bottom surfaces of the block and is spaced a selected distance "l" above the bottom surface. Channel 130 has a height "h" and a depth "d". However, it should be understood that the size, shape and dimensions of the indentation in the rear face of the wall block depend primarily on the size, shape and dimensions of the portion of the connector which is received in the indentation. In other words, the indentation need be sized and shaped to receive the connector and could be one or more shorter channels or elongate slots, or one or more cylindrical, square or rectangular holes depending on the number of connectors intended to be used with the block.

Front face 104 may have a compound shape and may protrude outward from top and bottom surfaces 102 and 103, respectively, in a direction generally away from block body 120, and/or extend into the block body 120 towards the rear face 105 of the block. It should be understood that block 100 is not limiting and that block 100 could have any desired shape and could be any desired dimension. It should be further understood that front face 104, top and bottom surfaces 102 and 103 and side walls 106 and 107 could have any shape, pattern or texture as desired and could be substantially flat or planar.

Figure 4:
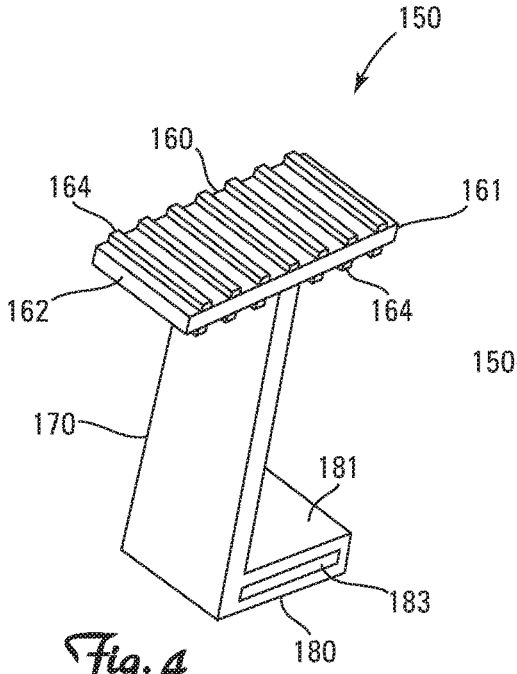
FIG. 4 is a perspective view of a first block connector for use with the block embodiment of FIGS. 1 to 3.

FIG. 4 is a perspective view of a block connector 150 for use with block 100. Connector 150 has an upper portion 160, a lower portion 180 and an intermediate portion 170 disposed between the upper and lower portions. Upper portion 160 includes first and second extending members 161 and 162. Extending members 161 and 162 are provided with a plurality of friction fins 164 and extend in first and second opposing directions with respect to intermediate portion 170. Intermediate portion 170 extends between and connects upper portion 160 to lower portion 180. Lower portion 180 includes a projection 181 which extends from intermediate portion 170 in the same direction as first extending member 161. As described in more detail below, the length which projection 181 extends from intermediate member 170 determines the amount of setback between courses of blocks in a wall constructed with the blocks and connector of the first embodiment. Projection 181 may optionally be provided with a core 183 as shown in FIG. 4. Although not shown, other portions of this connector or the other connector embodiments disclosed herein could be modified to include a core to enhance the structural integrity of the connector or to reduce the amount of material required to make the connector. Intermediate portion 170 is sized so that the distance between extending member 161 and projection 181 is at least as great as distance "l" which is the distance between channel 130 and the bottom surface 103 of block 100. Connector 150 is made from any material having sufficient strength and durability to withstand the pressures exerted on the connector during its intended use. For example, the connector may be made from plastic material, fiber glass, metal or other suitable material that is capable of being bent, casted, molded or stamped.

Extending members 161 and 162 extend from intermediate member 170 a distance of no more than about the depth "d" of channel 130 and are sized and shaped so that either may be received, and frictionally retained, in channel 130 of block 100. This allows connector 150 to be attached to block 100 in either of two selectable orientations as described in connection with FIGS. 5 and 6 below.

Figure 5:
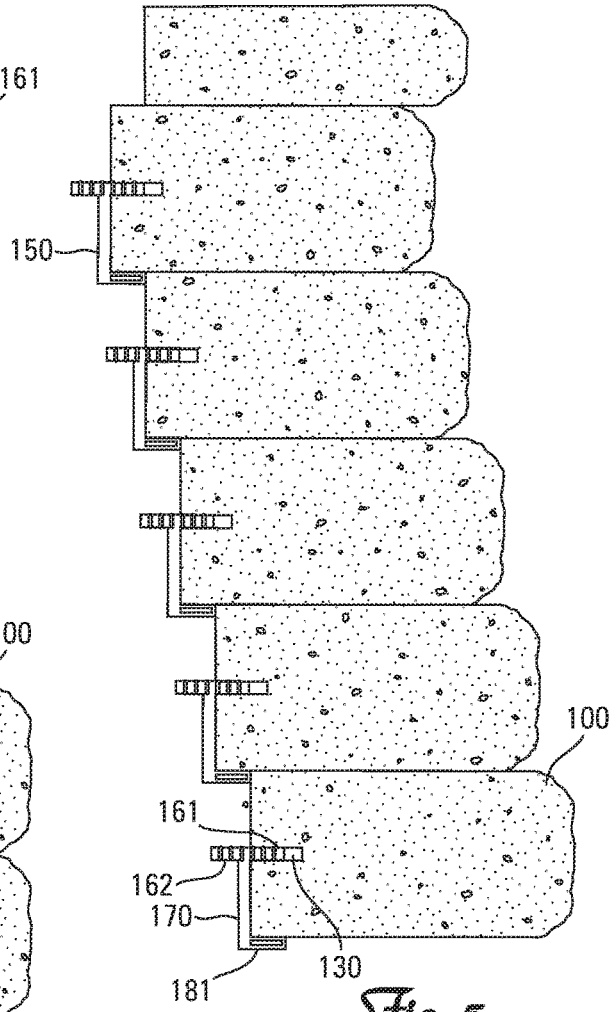
FIG. 5 is a side view of a wall constructed with the blocks of FIGS. 1 to 3 and the connector of FIG. 4 positioned in a first orientation.

FIG. 5 is a side view of a wall constructed with blocks 100 and connector 150. In FIG. 5 connector 150 is used in the first orientation with extending member 161 inserted in channel 130. This orientation results in the wall being constructed with a setback from course to course equal to the distance which projection 181 extends from the intermediate portion 170 of the connector. As shown in FIG. 5, in this orientation extending member 161 is received in channel 130 and is sized so that friction fins 164 are deformed by the upper and lower walls of channel 130 and hold the connector in place without the use of separate bonding materials. Intermediate portion 170 spans the distance between the channel 130 and the bottom surface 103 of the block so that projection 181 is located in a position just beneath the bottom surface of the block. In this position projection 181 abuts the rear surface of the blocks in the lower adjacent course to maintain the setback of the blocks from course to course and to secure the courses of blocks to one another and prevent displacement of the blocks from one course to another.

Figure 6:
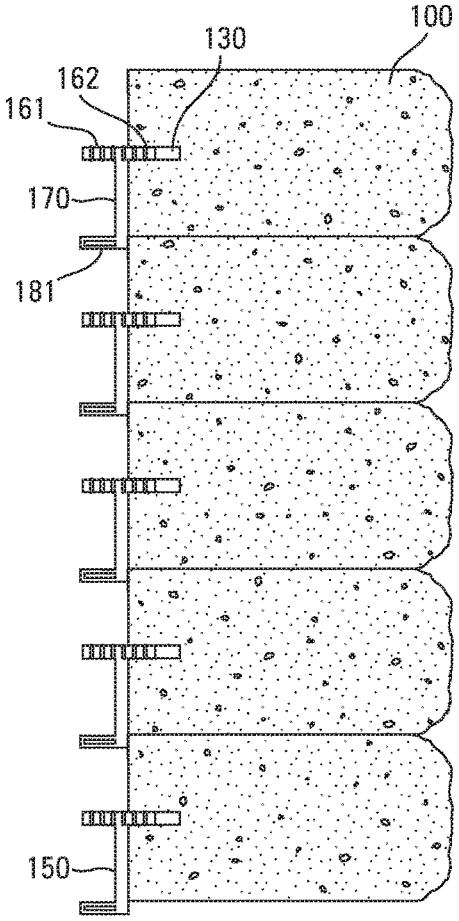
FIG. 6 is a side view of a wall constructed with the blocks of FIGS. 1 to 3 and the connector of FIG. 4 positioned in a second orientation.

FIG. 6 is a side view of a wall constructed with blocks 100 and connector 150. In FIG. 6 connector 150 is used in the second orientation with extending member 162 inserted in channel 130. This orientation results in the wall being constructed with no setback from course to course. Extending member 162 is sized so that friction fins 164 are deformed by the walls of channel 130 and hold the connector in place without the use of separate bonding materials. Intermediate portion 170 extends from channel 130 to a position below the bottom surface 103. In this second orientation projection 181 extends away from the rear face 105 of the block to which the connector is attached and away from the rear face of the block in the next lower course. Thus, when the connector is attached in the second orientation the rear face 105 of the block in the lower course abuts intermediate portion 170 of the connector. This results in the blocks being vertically aligned from course to course.

Figure 7:
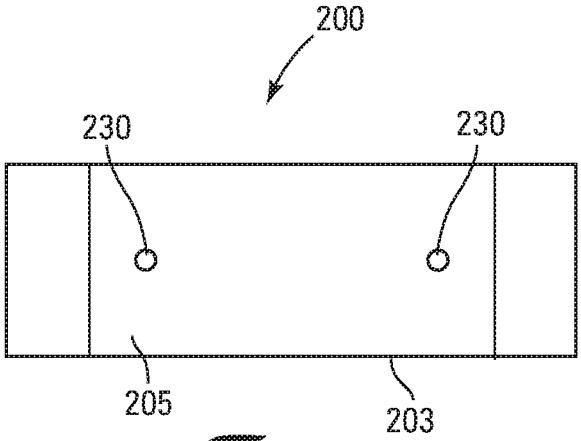
FIG. 7 is a back view of a second block embodiment.

A second block embodiment is shown in FIG. 7 which is a rear view of block 200. Block 200 is similar to block 100 except for the rear face 205 which, instead of a channel, has one or more indentations which may have the shape of one or more cylindrical holes 230 as shown in FIG. 7 or, alternatively, oval, square, rectangular, triangular or other shape which conforms to a connector received in the indentation such as the connector shown in FIG. 8.

Figure 8:
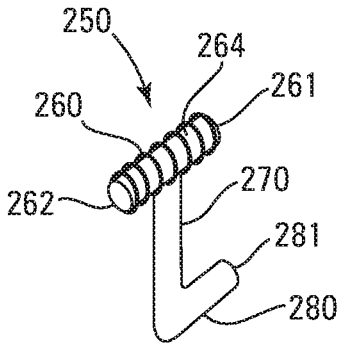
FIG. 8 is a perspective view of a second block connector for use with the block embodiment of FIG. 7.

FIG. 8 is a perspective view of a block connector 250 for use with block 200. Connector 250 has a configuration similar to connector 150 except that its portions are generally tubular in shape. Connector 250 has an upper portion 260, a lower portion 280 and an intermediate portion 270 disposed between the upper and lower portions. Upper portion 260 includes first and second extending members 261 and 262 which are tubular in shape and sized to be received in cylindrical holes 230. Extending members 261 and 262 are provided with a plurality of friction fins 264 and extend in first and second opposing directions with respect to intermediate portion 270. Intermediate portion 270 extends between and connects upper portion 260 to lower portion 280. Lower portion 280 includes a projection 281 which extends from intermediate portion 270 in the same direction as first extending member 261. Projection 281 is similar to projection 181 of connector 150. The length which projection 281 extends from intermediate member 270 determines the amount of setback between courses of blocks in a wall constructed with the blocks and connector of the second embodiment when extending member 261 is received in cylindrical hole 230 of block 200. Intermediate portion 270 is sized so that the distance between extending member 261 and projection 281 is at least as great as the distance between holes 230 and the bottom surface 203 of block 200. Connector 250 is made from materials similar to connector 150.

Extending members 261 and 262 extend from intermediate member 270 a distance of no more than about the depth of holes 230 and are sized and shaped so that either may be received, and frictionally retained, in one of holes 230 of block 200. This allows connector 250 to be attached to block 200 in either of two orientations in a manner similar to the way connector 150 is attached to block 100.

Since connector 250 looks similar to connector 150 in side view, FIGS. 5 and 6 are instructive in showing the two connection orientations of connector 250. In a first connection orientation extending member 261 of a connector 250 is inserted in one of holes 230. This orientation results in the wall being constructed with a setback from course to course equal to the distance which projection 281 extends from the intermediate portion 270 of the connector. Extending member 261 is sized so that friction fins 264 are deformed by the walls of hole 230 and hold the connector in place without the use of separate bonding materials. Intermediate portion 270 spans the distance between hole 230 and the bottom surface 203 of the block so that projection 281 is located in a position just beneath the bottom surface of the block to which the connector is attached. In this position projection 281 abuts the rear surface of the blocks in the lower adjacent course to maintain the setback of the blocks from course to course and to secure the courses of blocks to one another and prevent displacement of the blocks from one course to another in a manner similar to that shown in FIG. 5 with respect to connector 150.

Connector 250 is used in the second orientation with extending member 262 inserted in one of holes 230. This orientation results in the wall being constructed with no setback from course to course. Extending member 262 is sized so that friction fins 264 are deformed by the walls of hole 230 and hold the connector in place without the use of separate bonding materials. Intermediate portion 270 extends from hole 230 to a position below the bottom surface 203. In this second orientation projection 281 extends away from the rear face 205 of the block to which the connector is attached and away from the rear face of the block in the next lower course. Thus, when the connector 250 is attached in the second orientation the rear face 205 of the block in the lower course abuts intermediate portion 270 of the connector. This results in the blocks being vertically aligned from course to course in a manner similar to that shown in FIG. 6 with respect to connector 150.

Figure 9:
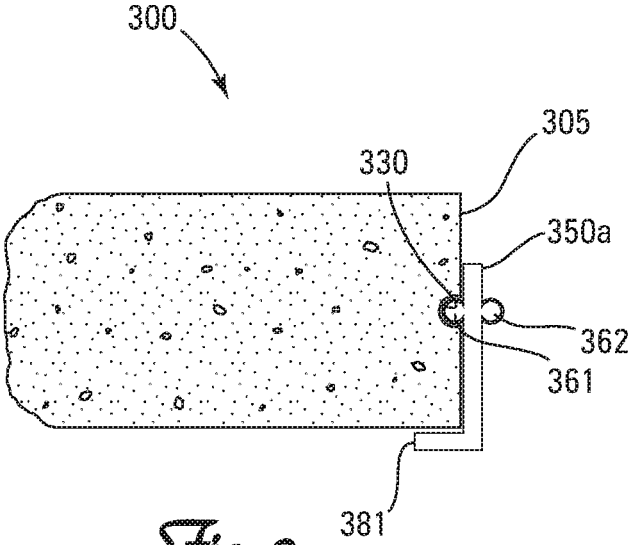
FIG. 9 is a side view of a third block embodiment and associated block connector.

A third block embodiment and associated block connector is shown in FIG. 9 which is a side view of block 300 and connector **350*a*. Block 300 is similar to block 100 except for the shape of the indentation in the rear face 305. Whereas the channel in block 100 has a generally rectangular shaped cross-section block 300 has a channel 330 that opens to the rear face 305 of the block and extends into the body of block 300 to define a cross-sectional shape that is not rectangular. Although channel 330 is shown in FIG. 9 as being semi-spherical in cross-section it should be understood that channel 330 could have other cross-sectional shapes such as T-shaped, L-shaped, dovetail or other desired shape which forms a non-rectangular interior channel cavity which prevents a connector from being removed or forced out of the channel through the opening in the rear face of the block. For example, channel 330 could have a shape similar to channel 130 of block 100, shown in FIGS. 1 to 3, if channel 130** were provided with an internal "T" or "L" shaped extension.

Figure 10:
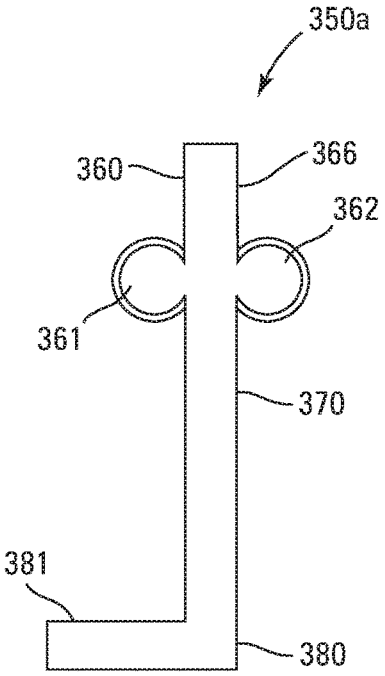
FIGS. 10 and 11 are side and perspective views of the block connector of FIG. 9.
Figure 11:
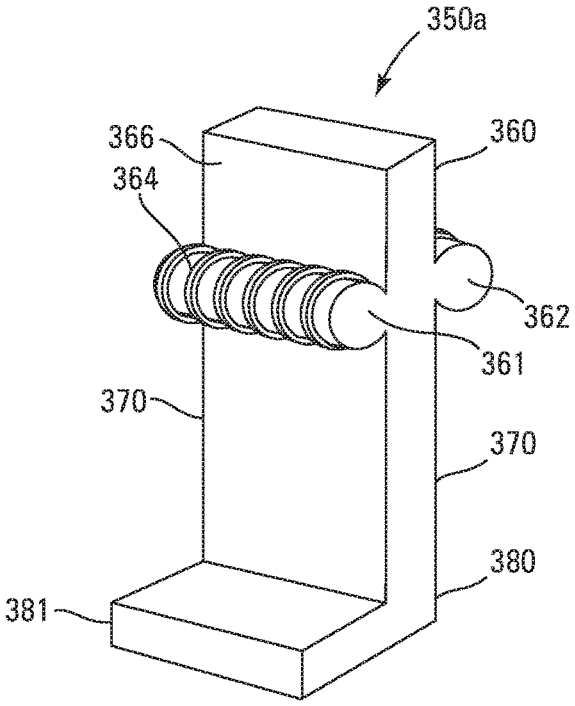

FIGS. 10 and 11 are side and perspective views of block connector **350*a* for use with block 300. Connector 350*a* has a configuration similar to connector 150 except that its extending portions have a semi-spherical shape configured to mate with the semi-spherical shape of channel 330. Connector 350*a* has an upper portion 360, a lower portion 380 and an intermediate portion 370 disposed between the upper and lower portions. Upper portion 360 includes first and second extending members 361 and 362 having a semi-spherical shape sized to be received in channel 330 of block 300. Optionally, extending members 361 and 362 may have an angular shape which may include upper and lower peaks to facilitate placement and retention of the extending members within channel 330. It should be understood that if channel 330 was made with a different shape, such as T-shape, L-shape or dovetail, the extending portions of connector 350***a* would be made with a complimentary mating shape. During use connector 350*a* is inserted by an installer into channel 330 at the side of block 300 and moved to a desired location along the back of block 300. The shape of the internal cavity of channel 330 prevents connector 350*a* from being removed or forced out of the channel through the channel opening in the rear face of the block. Extending members 361 and 362 are provided with a plurality of optional friction fins 364 and extend in first and second opposing directions with respect to intermediate portion 370. Friction fins are optional since channel 330 is shaped to prevent connector 350*a* from being removed through the opening into the rear face of block 300. Upper portion 360 includes section 366 which extends upwardly above extending members 361 and 362 as an extension of intermediate portion 370. Section 366 provides connector 350*a* with additional strength and is sized to prevent extending members 361 or 362, depending on orientation of the connector, from rotation within channel 330. It should be understood that similar upwardly extending sections could be included in connectors 150 and 250 described above. Intermediate portion 370 extends between and connects upper portion 360 to lower portion 380. Lower portion 380 includes a projection 381 which extends from intermediate portion 370 in the same direction as first extending member 361. Projection 381 is similar to projection 181 of connector 150 except that it does not have a core. The length which projection 381 extends from intermediate member 370 determines the amount of setback between courses of blocks in a wall constructed with the blocks and connector of the third embodiment when extending member 361 is received in channel 330 of block 300. Intermediate portion 370 is sized so that the distance between extending member 361 and projection 381 is at least as great as the distance between channel 330 and the bottom surface 303 of block 300. Connector 350*a* is made from materials similar to connector 150.

Extending members 361 and 362 of connector 350*a* extend from intermediate member 370 a distance of no more than about the depth of channel 330 and are sized and shaped so that either may be received in channel 330 of block 300. This allows connector 350*a* to be attached to block 300 in either of two orientations in a manner similar to the way connectors 150 and 250 are attached to blocks 100 and 200, respectively.

In a first connection orientation extending member 361 of a connector 350*a* is inserted in channel 330. This orientation results in the wall being constructed with a setback from course to course equal to the distance which projection 381 extends from the intermediate portion 370 of the connector in a manner similar to that shown in FIG. 5 with respect to connector 150. Extending member 361 is sized so that friction fins 364, if optionally provided, are deformed by the walls of the channel 330 and hold the connector in place without the use of separate bonding materials. In a second connection orientation extending member 362 inserted in channel 330. This orientation results in the wall being constructed with no setback from course to course. Extending member 362 is sized so that friction fins 364, if optionally provided, are deformed by the walls of channel 330 and hold the connector in place without the use of separate bonding materials. When the connector 350*a* is attached in the second orientation the rear face 305 of the block in the lower course abuts intermediate portion 370 of the connector. This results in the blocks being vertically aligned from course to course in a manner similar to that shown in FIG. 6 with respect to connector 150.

Figure 12:
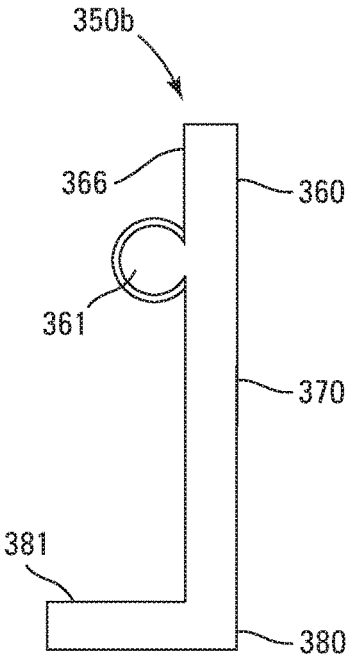
FIGS. 12 and 13 are side and perspective views of an alternative block connector for use with the block of FIG. 9.
Figure 13:
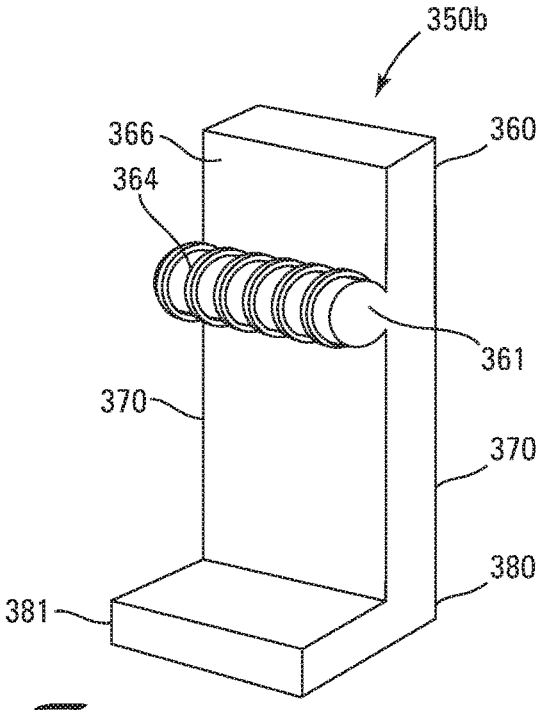

FIGS. 12 and 13 are side and perspective views of a connector 350*b* that is configured for use with block 300. Connector 350*b* is identical to connector 350*a* and the same reference numerals are used to identify the parts of connector 350*b* except that connector 350*b* does not have an extending member 362. Therefore, connector 350*b* is capable of being attached to block 300 in only the first connection orientation, as described above with respect to connector 350*a*. Use of connector 350*b* results in the wall being constructed with a setback from course to course equal to the distance which projection 381 extends from the intermediate portion 370 of the connector in a manner similar to that shown in FIG. 5 with respect to connector 150. It should be mentioned that it is within the scope of the invention to make connectors 150 and 250 without extending members 162 and 262, respectively, so that their use would be limited to the first connection orientation described above.

Figure 14:
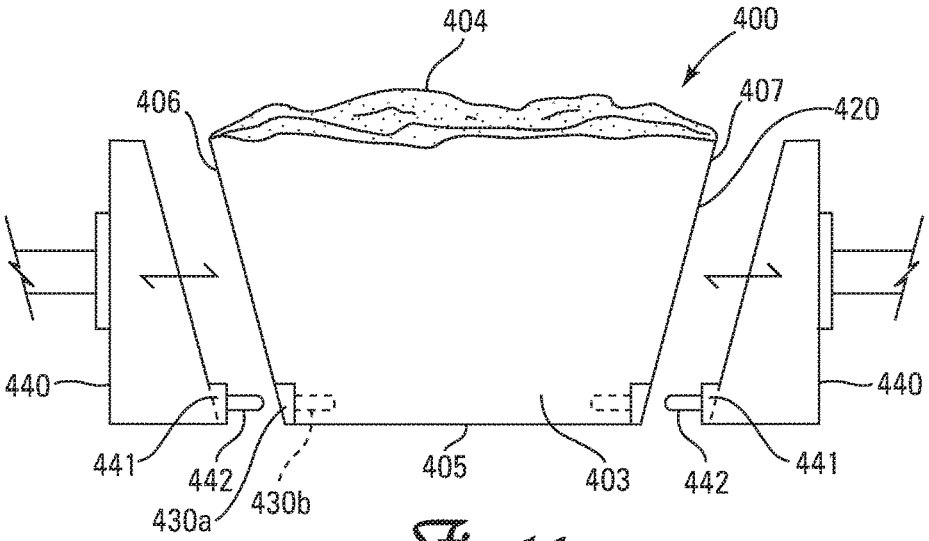
FIGS. 14, 15 and 16 are bottom, bottom perspective and side views of a fourth block embodiment.
Figure 15:
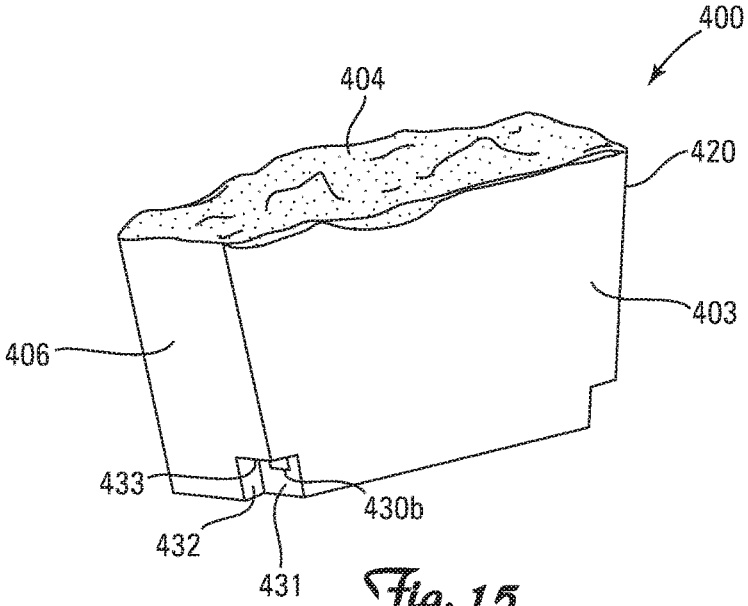
Figure 16:
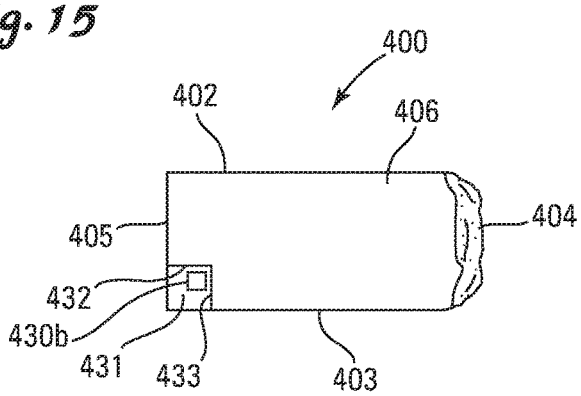

FIGS. 14, 15 and 16 show a fourth block embodiment and are bottom, bottom perspective and side views of block 400. Block 400 has a block body 420 having parallel top surface 402 and bottom surface 403, front face 404, rear face 405 and opposing side walls 406 and 407. Both front face 404 and rear face 405 extend from top surface 402 to bottom surface 403.

Side walls 406 and 407 each include a compound indentation including a first section 430*a* which extends a first depth into the block body 420 toward the opposing side wall and a second section 430*b* which extends a second depth, greater than the first depth, into the block body toward the opposing side wall. The first section 430*a* of the indentation opens to the side wall into which it is formed and to the bottom surface 403 and the rear face 405 and has a shape defined by surfaces 431, 432 and 433. Surface 431 may be substantially perpendicular to both bottom surface 403 and rear face 405. Surface 432 may be substantially perpendicular to rear face 405 and substantially parallel to top and bottom surfaces 402 and 403. Surface 433 may be substantially perpendicular to bottom surface 403 and substantially parallel to rear face 405. It should be understood, however, that surfaces 431, 432 and 433 can have various shapes and configurations that are appropriate to receive a block connector as described below. For example, surfaces 431, 432 and 433 could be non-planar, non-discrete and include various curves and angles shaped to receive a mating connector.

The second section 430*b* of the indentation is open to the first section 430*a* and extends further into the block body in the toward the opposing side wall in a direction that is generally parallel to the rear face of the block. Second section 430*b* is shaped and sized to receive an extending portion of a block connector, such as the connectors described in connection with FIGS. 17, 18 and 19. For example, section 430*b* could be round, square, rectangular, triangular or other desired shape.

FIG. 14 also shows a portion of a mold box used to make block 400 in an orientation where the block is made with its front face 404 at the top of the mold and its rear face 405 at the bottom of the mold. Specifically, FIG. 14 shows moveable side wall liners 440 which form side walls 406 and 407 during a block molding process. Liners 440 also include mirror image projections 441 and 442 that form the compound indentations in each side wall. Specifically, projection 441 forms section 430*a* of the indentation and projection 442 forms section 430*b* of the indentation. FIG. 14 shows the liners 440 in a partially retracted position. During the block making process the liners 440 would be positioned in a molding position and, together with a production pallet, and moveable or stationary liners (not shown) would combine to form a mold cavity that is filled with a moldable block material during the molding process. As shown in FIG. 14 block 400 may be made with the rear face positioned on the production pallet (not shown). Alternatively, the block could be formed in the mold with one of the top or bottom surfaces positioned on the production pallet. After the mold cavity is filled with block material the material is compressed from above by a stripper shoe (not shown) that forms the front face of the block. Thereafter, the moveable liners 440 are retracted to a discharge position to release the block from the mold box. It will be apparent that with appropriate modification to side liners 440 the blocks shown in FIGS. 24, 26, and 27 can be made in the same manner.

Front face 404 may have a compound shape and may protrude outward from top and bottom surfaces 402 and 403, respectively, in a direction generally away from block body 420, and/or extend into the block body 420 towards the rear face 405 of the block. It should be understood that block 400 is not limiting and that block 400 could have any desired shape and could be any desired dimension. It should be further understood that front face 404, top and bottom surfaces 402 and 403 and side walls 406 and 407 could have any shape, pattern or texture as desired and could be substantially flat or planar. Additional, it should be understood that although block 400 has been described as being made by a dry cast procedure it could also be made using a wet cast block making process.

Figure 17:
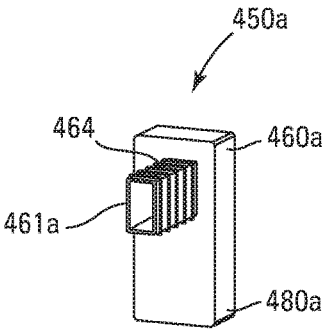
FIGS. 17, 18 and 19 are perspective views of alternative block connectors for use with the block of FIGS. 14 to 16.
Figure 18:
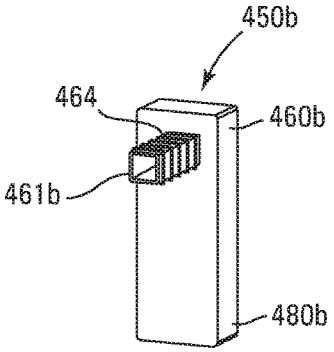
Figure 19:
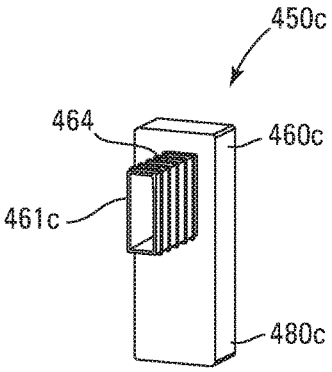
Figure 20:
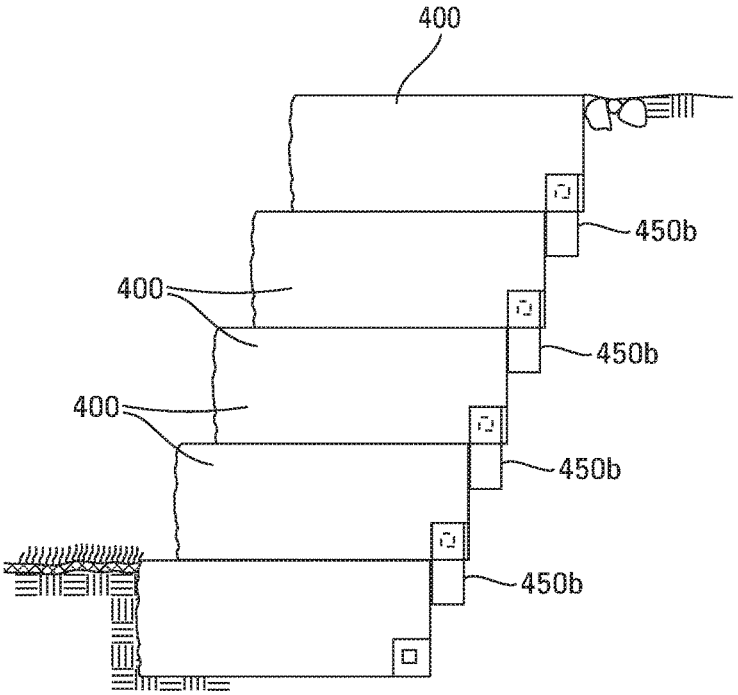
FIG. 20 is a partial side view of a wall built with the blocks of FIGS. 14 to 16 and the connector of FIG. 18.

FIGS. 17, 18 and 19 are perspective views of block connectors 450*a*, 450*b* and 450*c*. As discussed below, the shape of second section 430*b* of block 400 can be made to accept a mating portion of connector 450*a*, 450*b* or 450*c*. Each connector has an upper portion 460*a*, 460*b* and 460*c*, respectively, and a lower portion 480*a*, 480*b* and 480*c*, respectively. Upper portions 460*a*, 460*b* and 460*c* include extending members 461*a*, 461*b* and 461*c*, respectively, that are each provided with a plurality of friction fins 464. The extending members are shaped and sized to be received in the second section 430*b* of an indentation in a block 400 which has been shaped and sized to receive one of extending members 461*a*, 461*b* or 461*c* as applicable. As will be apparent from FIGS. 17, 18 and 19, the extending members and the upper and lower portions of the connectors can have different shapes which are sized to mate with mating receiving shapes of the first and second sections of the indentation in a block 400 in which they are received. For example, the extending members may have a cross-section that is square, rectangular, triangular, cruciform, dovetail, circular or other desired shape. Extending members 461*a*, 461*b* and 461*c* are sized so that friction fins 464 are deformed by the walls of second section 430*b* and hold the connector in place without the use of separate bonding materials. When the extending member is received in the second section of the indentation the lower portion of the connector is sized to extend below the bottom surface of the block to which the connector is attached. In this position, when the connector is used with blocks 400 to form a wall, the lower portion of the connector abuts the rear surface a block in the lower adjacent course to maintain the setback of the blocks from course to course and to secure the courses of blocks to one another and prevent displacement of the blocks from one course to another as shown in FIG. 20 which is a partial side view of a wall built with blocks 400 sized to receive connectors 450*b*.

Figure 21:
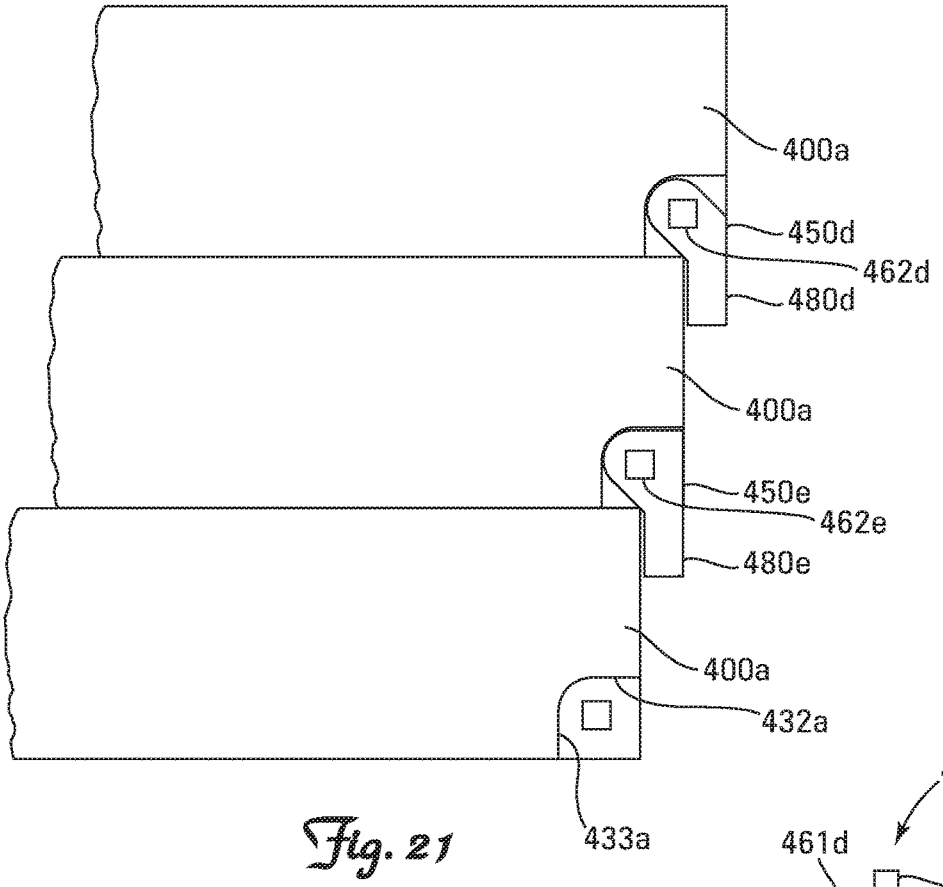
FIGS. 21 and 22 are partial side and partial rear perspective views, respectively, of a wall constructed with the blocks of FIGS. 14 to 16 and an alternative block connector.
Figure 23:
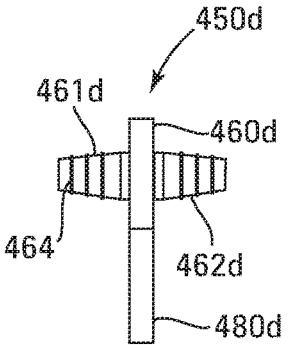
FIG. 23 is a front view of the connector of FIGS. 21 and 22.
Figure 22:
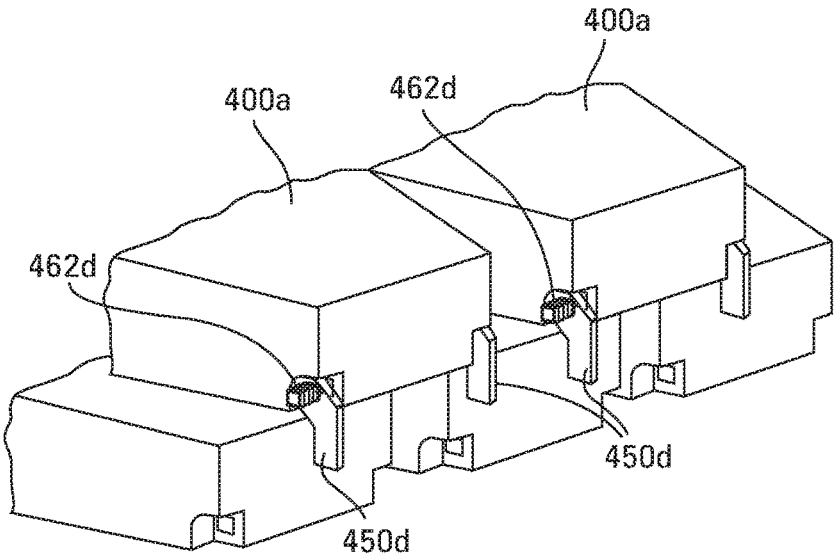

FIGS. 21 and 22 are partial side and partial rear perspective views of a wall constructed with blocks 400*a* using either connector 450*d* or connector 450*e* to connect blocks in adjacent courses of the wall. Block 400*a* is similar to block 400 except that surfaces 432*a* and 433*a* are curved and intersect to form an arcuate curved surface. Connector 450*d* is shown in side view in FIG. 21, perspective view in FIG. 22 and front view in FIG. 23. Connector 450*d* has an upper portion 460*d* and a lower portion 480*d*. Upper portion 460*d* includes first and second extending members 461*d* and 462*d*. Extending members 461*d* and 462*d* are provided with a plurality of friction fins 464 and extend in first and second opposing directions with respect to upper portion 460*d*. Lower portion 480*d* curves or bends away from the upper portion of the connector allowing a reduced setback from course to course in the wall. Specifically, the curved shape of the connector allows the second section of the indentation of block 400*a* to be spaced forward of the rear face of blocks in the adjacent lower course as shown, for example, in FIG. 21. It should be understood, however, that the curved shape could be squared off in more of an "L" shape as shown in connector 450*e* in FIG. 21 to provide the same setback function. Connector 450*e* is similar to connector 450*d* except that when inserted into block 400*a* it has an upper surface that abuts surface 432*a* of block 400*a* to further prevent or limit rotation of connector 450*e* with respect to block 400*a*. Extending members 461*d* and 462*d* allow the connector to be received in the indentation on either side of the block so that the connector may be used in a right handed or left handed orientation and only one connector style is needed to construct the wall, as shown in FIG. 22.

Figure 24:
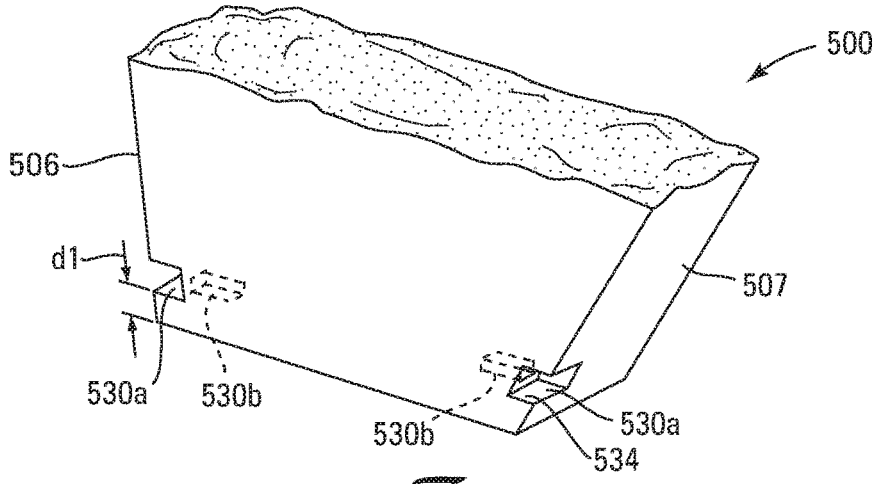
FIG. 24 is a bottom perspective view of a fifth block embodiment.
Figure 25:
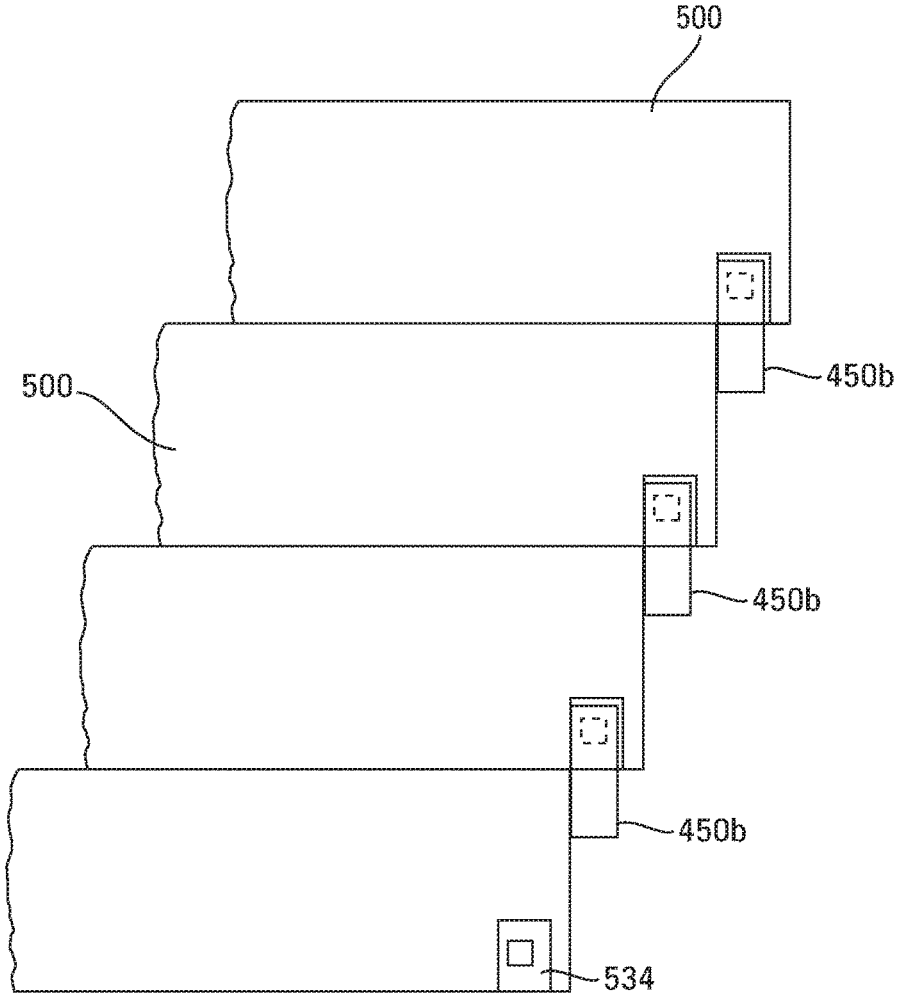
FIG. 25 is a partial side view of a wall constructed with the blocks of FIG. 24 and the connector of FIG. 18.

FIG. 24 is directed to a fifth block embodiment and is a bottom perspective view of block 500. Block 500 is similar in all respects to block 400 except for the shape and configuration of the compound indentations in each side wall. Specifically, side walls 506 and 507 include a compound indentation including a first section 530*a* and a second section 530*b*. First section 530*a* of block 500 is similar to first section 430*a* of block 400 except that it does not open onto the rear face of the block but instead is spaced from the rear face by a distance "dl". As shown in FIG. 25, which is a partial side view of a wall constructed with blocks 500 and connector 450*b*, the spacing of the first section from the rear face creates a back wall surface 534 which limits any movement of the connector towards the rear face of the block and, hence, limits any forward movement of blocks in the wall with respect to the adjacent lower course of blocks.

Figure 26:
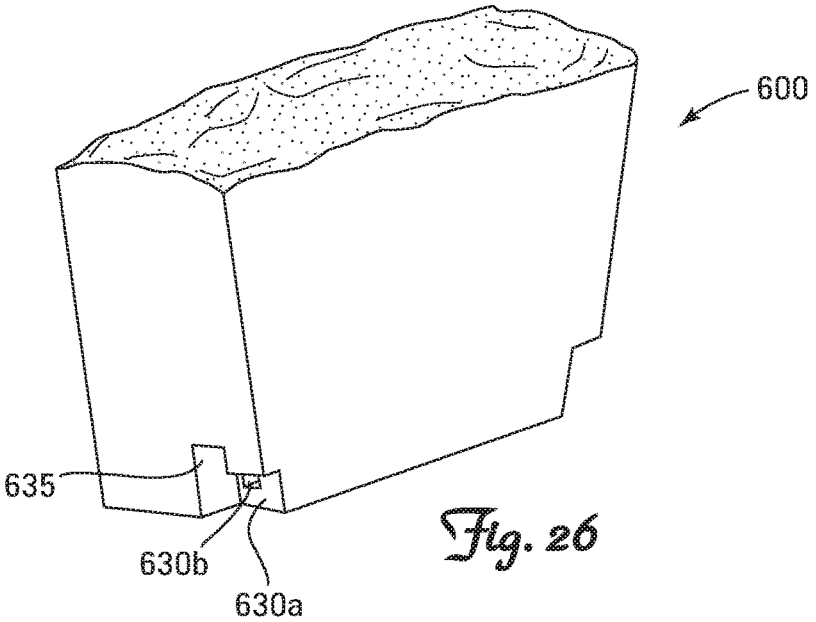
FIGS. 26 and 27 are bottom perspective views of sixth and seventh block embodiments.
Figure 27:
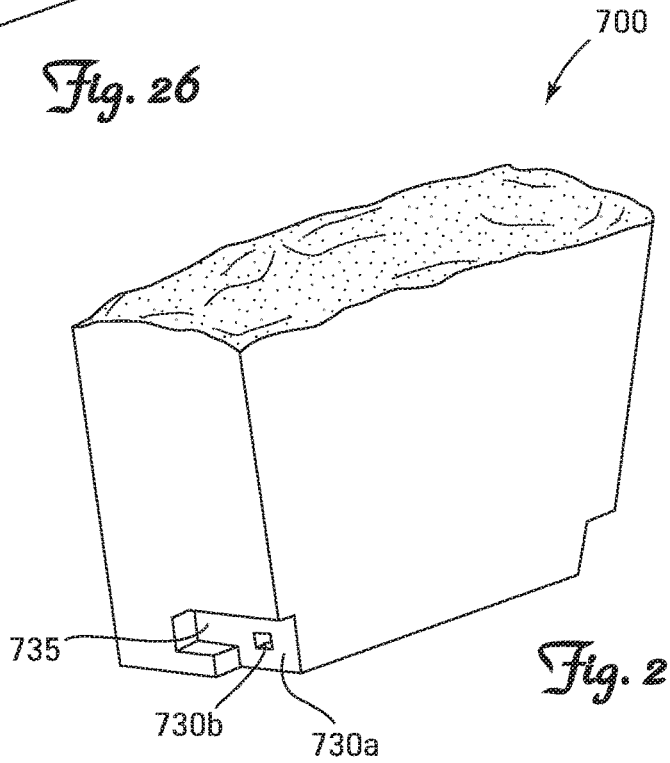
Figure 28:
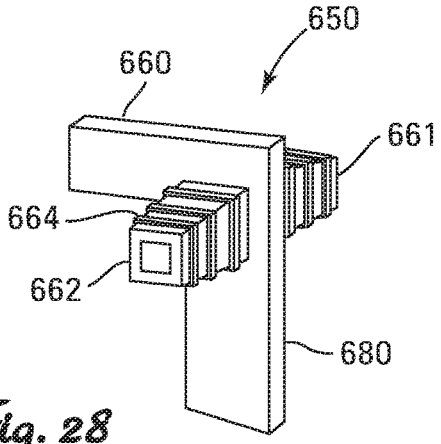
FIG. 28 is a perspective view of a block connector for use with the block of FIG. 26.
Figure 29:
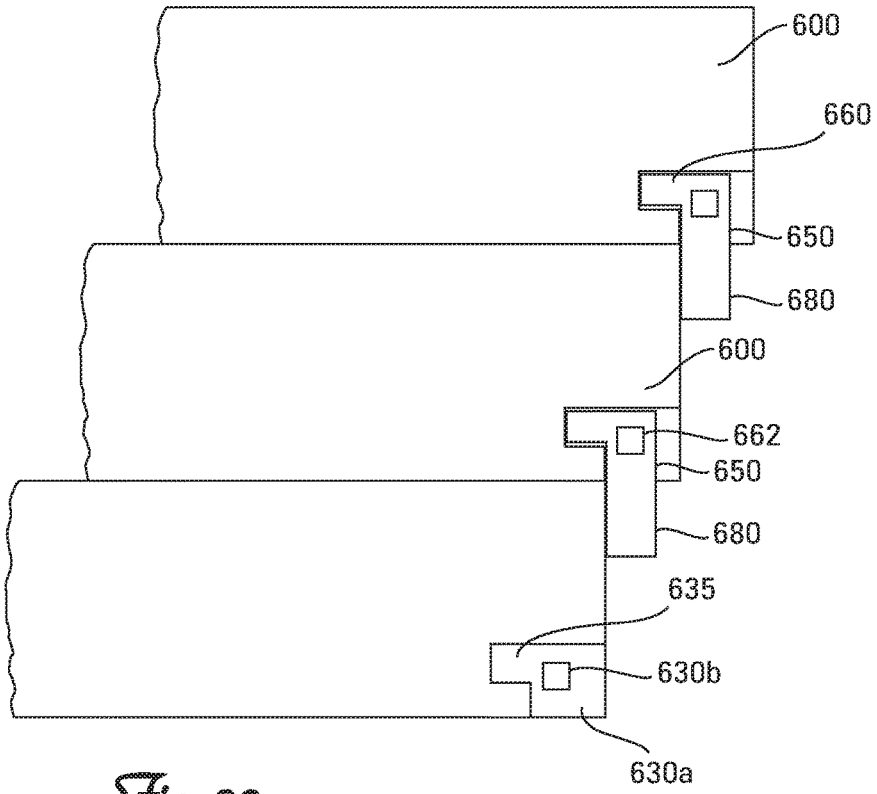
FIG. 29 is a partial side view of a wall constructed with the blocks of FIG. 26 and the block connector of FIG. 28.

It should be understood that the shape of the compound indentations and the block connectors that are received in them can be varied considerably. For example, FIGS. 26 and 27 are bottom perspective views of sixth and seventh block embodiments showing blocks 600 and 700, respectively. Blocks 600 and 700 are similar to block 400 except for the shape of the first section of the compound indentations in the side walls. Specifically, block 600 has compound side wall indentations which include a first section 630*a* and a second section 630*b*. However, first section 630*a* differs from first section 430*a* in that it includes a horizontal extension 635 which provides first section 630*a* with an inverted "L" shape appearance as clearly shown in FIG. 29 which is a partial side view of a wall constructed from blocks 600. Connector 650, shown in perspective view in FIG. 28, includes an upper portion 660 and a lower portion 680. The upper and lower portions join to form an "L" shape which is dimensioned to be received in first section 630*a* of the compound indentation as shown in FIG. 29. Upper portion 660 include extending members 661 and 662 that extend in opposite directions from upper portion 660 so that connector 650 can be received in the indentation on either side of the block. The extending members 661 and 662 are each provided with a plurality of friction fins 664. The extending members are shaped and sized to be received in the second section 630*b* of an indentation. FIG. 29 shows connectors 650 attached to the right side of blocks 600 with extending member 661 received in second section 630*b* of the compound indentation and with upper portion 660 received within horizontal extension 635 of first section 630*a* to help prevent or limit any rotational movement of the connector once it is received in the indentation. When the connector is used on the left side of the blocks extending member 662 is received in second section 630*b*. When the extending member is received in the second section of the indentation the lower portion of the connector is sized to extend below the bottom surface of the block to which the connector is attached. In this position, when the connector is used with blocks 600 to form a wall, as shown in FIG. 29, the lower portion of the connector abuts the rear surface a block in the lower adjacent course to maintain the setback of the blocks from course to course and to secure the courses of blocks to one another and prevent forward displacement of the blocks with respect to blocks in an adjacent lower course of blocks.

Figure 31:
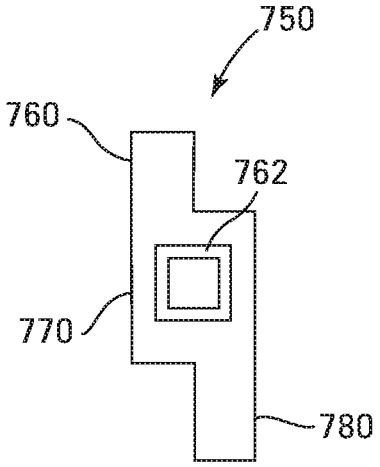
FIGS. 31 and 32 are side and back views of the connector shown in FIG. 30.
Figure 32:
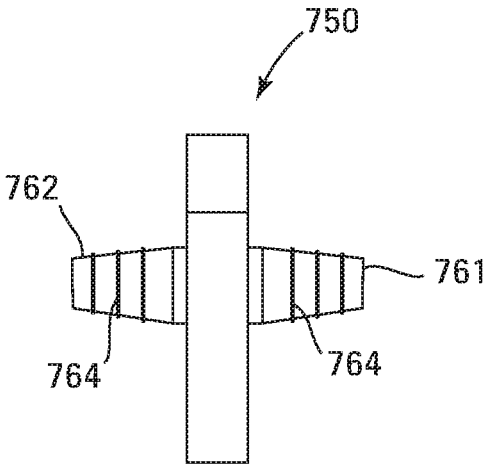

Block 700 is also similar to block 400 except for the shape of the first section of the compound indentations in the side walls. Specifically, block 700 has compound side wall indentations which include a first section 730*a* and a second section 730*b*. However, first section 730*a* differs from first section 430*a* in that it includes a vertical extension 735 which provides first section 730*a* with an "L" shaped appearance as clearly shown in FIG. 30 which is a partial side view of a wall constructed from blocks 700. Connector 750, shown in side and back views in FIGS. 31 and 32, includes an upper portion 760, an intermediate portion 770 and a lower portion 780. The intermediate portion 770 joins the upper and lower portion which are vertically offset from one another as best seen in FIG. 31. The intermediate portion 770 includes extending members 761 and 762 that extend in opposite directions from intermediate portion 770 so that connector 750 can be received in the indentation on either side of block 700. The extending members 761 and 762 are each provided with a plurality of friction fins 764. The extending members are shaped and sized to be received in the second section 730*b* of an indentation.

Figure 30:
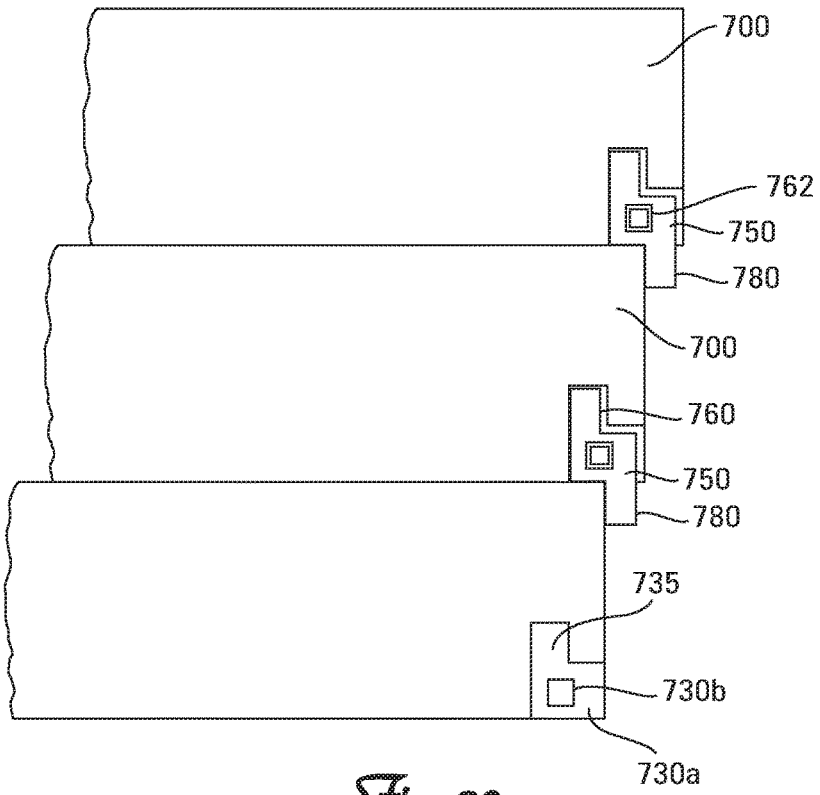
FIG. 30 is a partial side view of a wall constructed with the block of FIG. 27 and the connector of FIGS. 31 and 32.

FIG. 30 shows connectors 750 attached to the right side of blocks 700 with extending member 761 received in second section 730*b* of the compound indentation and with upper portion 760 received within vertical extension 735 of first section 730*a* to help prevent or limit any rotational movement of the connector once it is received in the indentation. When the connector is used on the left side of the blocks extending member 762 is received in second section 730*b*. When the extending member is received in the second section of the indentation the lower portion of the connector is sized to extend below the bottom surface of the block to which the connector is attached. In this position, when the connector is used with blocks 700 to form a wall, as shown in FIG. 30, the lower portion of the connector abuts the rear surface a block in the lower adjacent course to maintain the setback of the blocks from course to course and to secure the courses of blocks to one another and prevent displacement of the blocks from one course to another. Although not shown, it should be apparent that any of the connectors 450*d*, 450*e*, 650 and 750 could be shaped to maintain a zero setback of the wall from one course to another.

Figure 33:
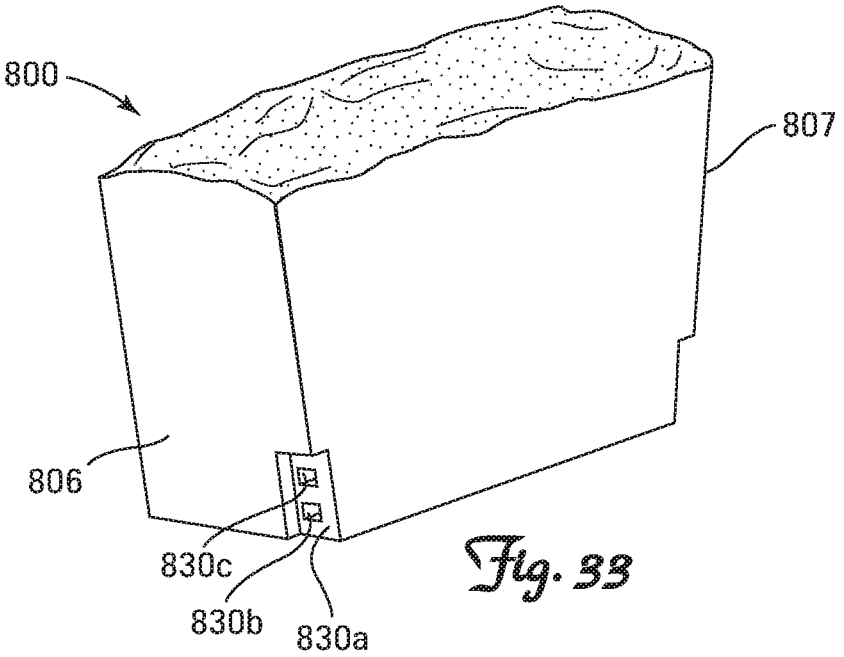
FIG. 33 is a bottom perspective view of an eighth block embodiment.
Figure 34:
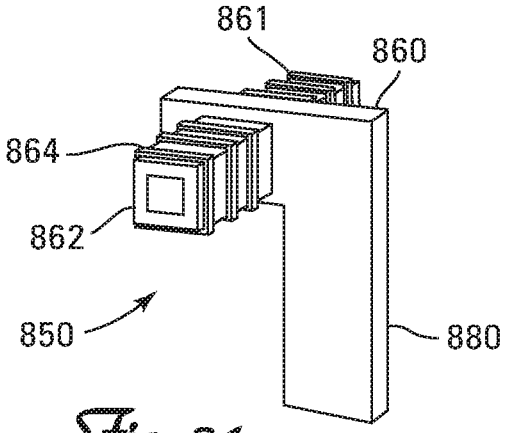
FIGS. 34 and 35 are perspective and front views, respectively, of a block connector for use with the block of FIG. 33.
Figure 35:
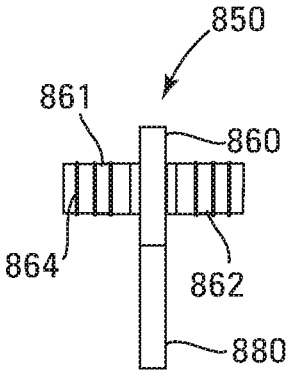

FIG. 33 is directed to an eighth block embodiment and is a bottom perspective view of block 800. Block 800 is similar in all respects to block 400 except for the shape and configuration of the compound indentations in each side wall. Specifically, side walls 806 and 807 include a compound indentation including a first section 830*a*, a second section 830*b* and a third section 830*c*. Block 800 is configured to be used with a connector having an extending member which is shaped and sized to be received in either second section 830*b* or third section 830*c*. For example, connector 850, shown in perspective and front views, respectively, in FIGS. 34 and 35 is suitable for use with block 800. Connector 850 includes an upper portion 860 and a lower portion 880. The upper and lower portions join to form an "L" shape. Upper portion 860 is dimensioned to be received in first section 830*a* of the compound indentation. Upper portion 860 includes extending members 861 and 862 that extend in opposite directions from upper portion 860 so that connector 850 can be received in the indentation on either side of the block. The extending members 861 and 862 are each provided with a plurality of friction fins 864. The extending members are shaped and sized to be received in either the second section 830*b* or the third section 830*c* of an indentation in a side wall of block 800, depending on whether it is desired to construct a vertical wall or a wall having a setback from course to course.

Figure 36:
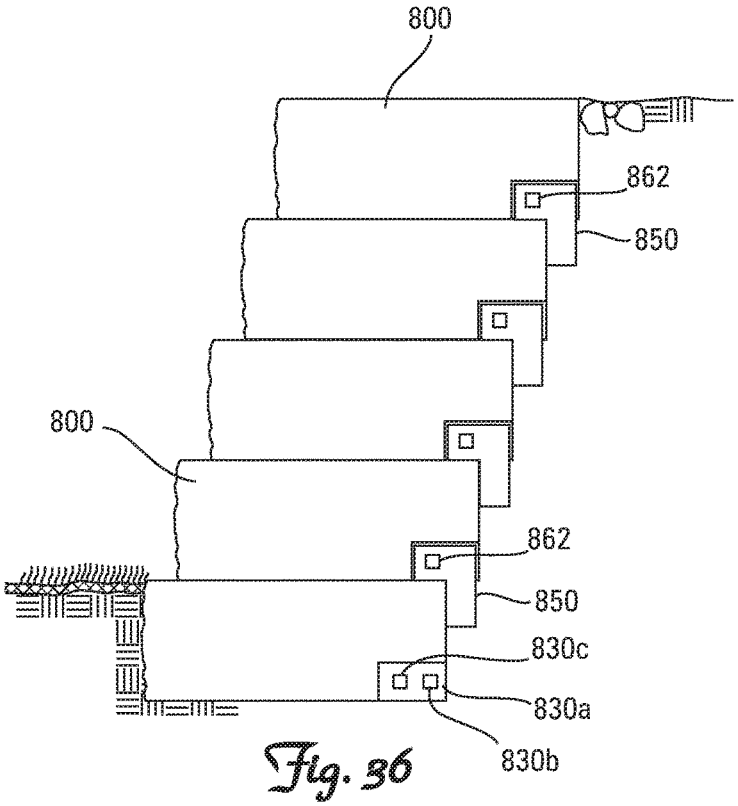
FIG. 36 is a partial side view of a wall constructed with a desired setback with the blocks of FIG. 33 and the block connector of FIGS. 34 and 35.
Figure 37:
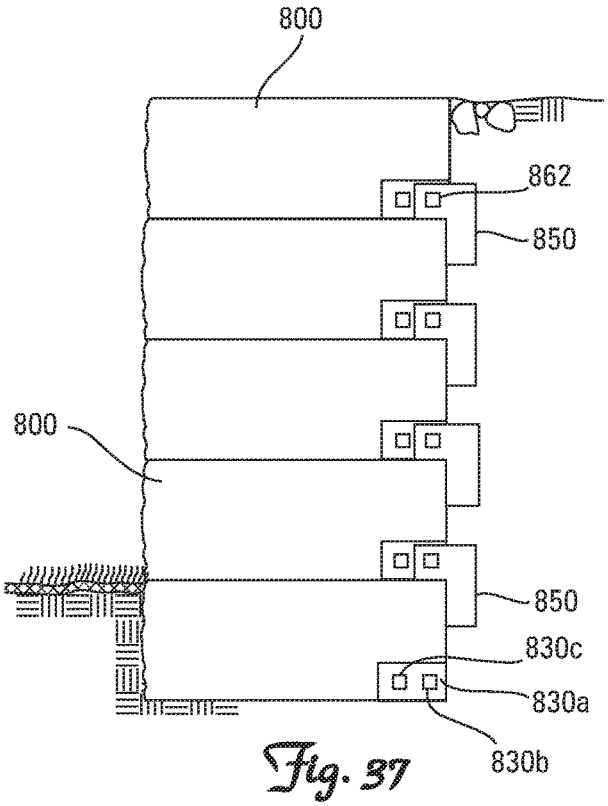
FIG. 37 is a partial side view of a vertical wall constructed with the blocks of FIG. 33 and the connector of FIGS. 34 and 35.

FIGS. 36 and 37 are partial side views of walls constructed using blocks 800 and connectors 850. In FIG. 36 the wall is constructed with a setback. The wall setback is achieved by inserting extending member 861 of connector 850 into third section 830*c* of block 800 which results in connector 850 assuming a more forward position with respect to the block 800 into which it is inserted. With connector 850 in this position a setback is created between block courses as shown in FIG. 36. Although not shown in FIG. 36 it will be understood that a connector 850 can optionally be inserted into the indentations in both side walls of the blocks 800 to enhance the stability of the wall. In FIG. 37 the wall is constructed with a zero setback and extends vertically. The zero wall setback is achieved by inserting extending member 861 of connector 850 into second section 830*b* of block 800 which results in connector 850 assuming a more rearward position with respect to the block 800 into which it is inserted. With connector 850 in this position a zero setback is created between block courses as shown in FIG. 37 so that the wall is vertical.

Figure 38:
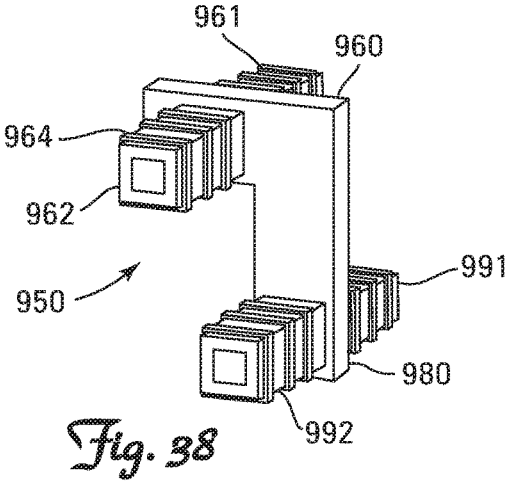
FIG. 38 is a perspective view of a block connector for use with a block similar to the block of FIG. 33.
Figure 39:
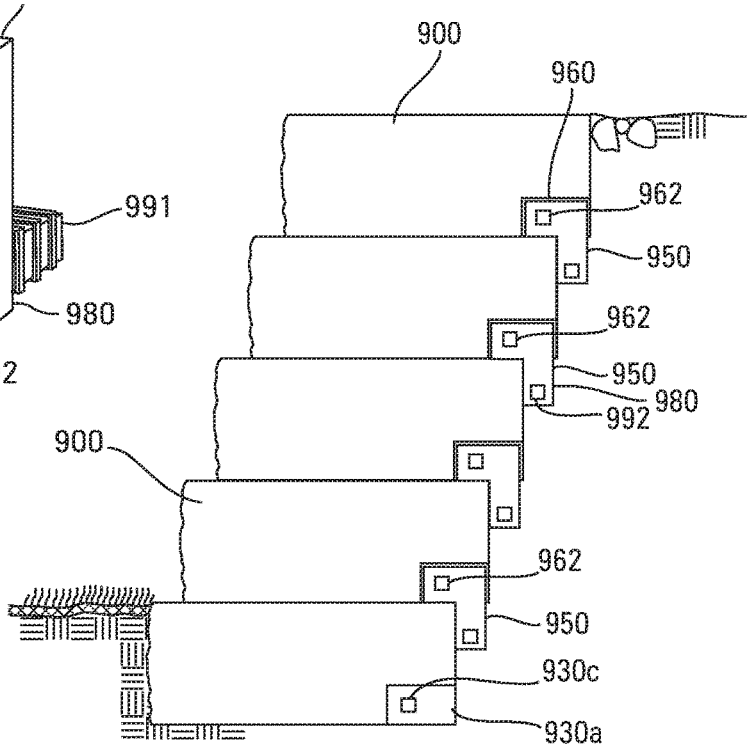
FIG. 39 is a partial side view of a wall constructed with a desired setback with the block connector of FIG. 38.
Figure 40:
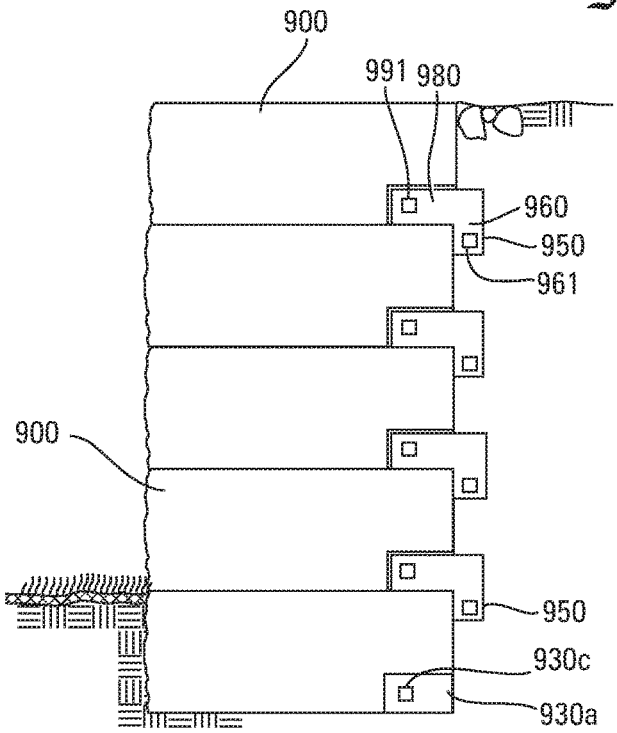
FIG. 40 is a partial side view of a vertical wall constructed with the connector of FIG. 38.

Another block system comprising a block 900 and connector 950 is shown in FIGS. 38, 39 and 40. Block 900 is similar in all respects to block 800 except that second section 830*b* of the compound indentation is omitted. More specifically, the side walls of block 900 have compound indentations that include a first section 930*a* similar to first section 830*a* of block 800 and a second section 930*c* similar to third section 830*c* of block 800. Block 900 is configured to be used with connector 950. Connector 950 is similar to connector 850 except that it includes an opposing set of extending members on each leg of the L-shaped connector.

Connector 950, shown in perspective shown in perspective in FIG. 38, includes an upper portion 960 and a lower portion 980. The upper and lower portions join to form an "L" shape. Since the length of the lower portion is greater than the length of the upper portion the connector can be used in multiple orientations to construct either a vertical wall or a wall with a desired non-zero setback, as described below. Upper portion 960 is dimensioned to be received in first section 930*a* of the compound indentation when the connector is used in a first orientation to construct a wall with a desired non-zero setback as shown in FIG. 39. Lower portion 980 is dimensioned to be received in first section 930*a* of the compound indentation when the connector is used in a second orientation to construct a vertical wall with a zero setback as shown in FIG. 40.

Upper portion 960 includes extending members 961 and 962 that extend in opposite directions from upper portion 960 so that connector 950 can be received in the indentation on either side of the block when the connector is used in the first orientation. The extending members 961 and 962 are each provided with a plurality of friction fins 964. The extending members are shaped and sized to be received in the second section 930*c* of an indentation in a side wall of block 900 when the connector is in the first orientation shown in FIG. 39. Lower portion 980 includes extending members 991 and 992 that extend in opposite directions from lower portion 980 so that the lower portion of connector 950 can be received in the indentation on either side of the block when the connector is used in the second orientation shown in FIG. 40. The extending members 991 and 992 are each provided with a plurality of friction fins 964. The extending members 991 and 992 are shaped and sized to be received in the second section 930*c* of an indentation in a side wall of block 900 when the connector is in the second orientation to construct a vertical wall as shown in FIG. 40.

FIGS. 39 and 40 are partial side views of walls constructed using blocks 900 and connectors 950. In FIG. 39 the wall is constructed with a desired non-zero setback. The wall setback is achieved by inserting extending member 961 of upper portion 960 of connector 950 into second section 930*c* of block 900 which results in the lower portion of connector 950 assuming a more forward position with respect to the block 900 into which it is inserted. With connector 950 in this position a setback is created between block courses as shown in FIG. 39. Although not shown in FIG. 39 it will be understood that a connector 950 can optionally be inserted into the indentations in both side walls of the blocks 900 to enhance the stability of the wall. In FIG. 40 the wall is constructed with a zero setback and extends vertically. As shown in FIG. 40, the zero wall setback is achieved by inserting extending member 992 of lower portion 980 of connector 950 into second section 930*b* of block 900 which results in the upper portion 960 of connector 950 assuming a more rearward position with respect to the block 900 into which it is inserted. With connector 950 in this position a zero setback is created between block courses as shown in FIG. 40 so that the wall is vertical.

Although particular embodiments have been disclosed herein in detail, this has been done for purposes of illustration only, and is not intended to be limiting with respect to the scope of the appended claims, which follow. In particular, it is contemplated by the inventors that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A wall block system for constructing a wall from a plurality of wall blocks stacked in at least an upper course of wall blocks and a lower course of wall blocks, the wall block system comprising:

a wall block having a block body with opposed front and rear faces, opposed first and second side walls, and opposed and parallel top and bottom planar surfaces, the block body having a depth defined by a distance between the front and rear faces, the block body having an indentation opening into the rear face and extending into the block body a distance less than the depth of the block body; and a block connector having upper, intermediate and lower portions, the upper portion being sized to be received within the indentation in the rear face of the wall block, the intermediate portion extending between the upper and lower portions and having a length at least as great as a distance between the indentation in the rear face of the wall block and the bottom planar surface of the wall block, the lower portion being sized to extend below the bottom planar surface of the wall block when the upper portion is received in the indentation such that, in a constructed wall, when the wall block is stacked in the upper course of blocks the lower portion of the block connector abuts against the rear face of an adjacent wall block in the lower course of blocks in the wall, wherein the upper portion of the connector includes a first member extending from the intermediate portion in a first direction and a second member extending from the intermediate portion in a second direction different from the first direction, the first and second members each being sized to be received and retained within the indentation, and wherein the lower portion of the connector includes a projection extending from the intermediate portion in the first direction, the connector being positioned in a first orientation when the first member is received within the indentation and in a second orientation when the second member is received within the indentation, such that, in a constructed wall, the upper course of blocks is setback from the lower course of blocks by a distance equal to a length of the projection when the connector is positioned in the first orientation and the upper course of blocks has a zero setback with respect to the lower course of blocks when the connector is positioned in the second orientation.

2. The wall block system of claim 1 wherein the indentation comprises a horizontal channel.

3. The wall block system of claim 2 wherein the channel has a cross-sectional shape which is one of T-shaped, L-shaped, semi-spherical and dovetail.

4. The wall block of claim 2 wherein the channel is open to at least one of the first and second side walls and shaped to permit insertion and removal of the upper portion of the block connector through the channel opening in at least one of the first and second side walls and to prevent removal of the upper portion of the block connector through the channel opening in the rear face of the block body.

5. The wall block system of claim 1 wherein the upper portion of the connector includes a plurality of fins sized to be deformed when the upper portion is received in the indentation to provide a friction fit to secure the connector to the wall block.

6. The wall block system of claim 1 wherein the indentation in the rear face of the wall block is at least a first and second indentation.

7. The wall block system of claim 6 wherein the at least first and second indentations are holes, each hole having a shape that is round, oval, square, rectangular or triangular.

8. The wall block system of claim 6 wherein the upper portion of the connectors include a plurality of fins sized to be deformed when the upper portion is received in the at least first and second indentations to provide a friction fit to secure the connector to the wall block.

9. A method for constructing a wall from a wall block system which includes a plurality of wall blocks having a rear face including an indentation extending into the body of the wall blocks and block connectors having upper, intermediate and lower portions, the method comprising:

positioning a first plurality of the wall blocks to form at least a portion of a first course of the wall;

attaching at least one connector to each of a second plurality of wall blocks such that the upper portion of the at least one connector is received in the indentation in the rear face of the wall block, the intermediate portion of the connector extends along the rear face of the wall block between the indentation and a bottom surface of the wall block, and the lower portion of the connector extends below the bottom surface of the wall block; and stacking the second plurality of wall blocks on the first plurality of wall blocks to form at least a portion of a second course of the wall, the lower portion of the at least one connector attached to each of the second plurality of wall blocks abutting a rear face of at least one of the blocks in the first course to thereby prevent forward movement of the second plurality of wall blocks with respect to the first course of the wall, wherein the upper portion of each block connector includes a first member extending from the intermediate portion in a first direction and a second member extending from the intermediate portion in a second direction different from the first direction, the first and second members each being sized to be received and retained within the at least one indentation, and wherein the lower portion of each block connector includes a projection extending from the intermediate portion in the first direction, the block connector being positioned in a first orientation when the first member is received within the at least one indentation and in a second orientation when the second member is received within the at least one indentation such that the second course of blocks is setback from the first course of blocks by a distance equal to a length of the projection when the block connector is positioned in the first orientation and the second course of blocks has a zero setback with respect to the first course of blocks when the block connector is positioned in the second orientation.

10. The method of claim 9 wherein the indentation in the rear face of the plurality of wall blocks comprises a horizontal channel.

11. The method of claim 10 wherein the channel has a cross-sectional shape which is one of T-shaped, L-shaped, semi-spherical and dovetail.

12. The method of claim 10 wherein the channel is open to at least one of the first and second side walls and shaped to permit insertion and removal of the upper portion of the block connector through the channel opening in at least one of the first and second side walls and to prevent removal of the upper portion of the block connector through the channel opening in the rear face of the block body.

13. The method of claim 9 wherein the upper portion of the block connectors includes a plurality of fins sized to be deformed when the upper portion is received in the indentation to provide a friction fit to secure the block connector to the wall block.

14. The method of claim 9 wherein the indentation in the rear face of the plurality of wall blocks is at least a first and second indentation.

15. The method of claim 14 wherein the at least first and second indentations are holes, each hole having a shape that is round, oval, square, rectangular or triangular.

16. The method of claim 14 wherein the upper portion of the block connectors includes a plurality of fins sized to be deformed when the upper portion is received in the at least first and second indentations to provide a friction fit to secure the connector to the wall block.

17. A method for constructing a wall, the method comprising:

providing a plurality of wall blocks having a block body with opposed front and rear faces, opposed first and second side walls, and opposed and parallel top and bottom planar surfaces, the block body having a depth defined by a distance between the front and rear faces, the block body having an indentation opening into the rear face and extending into the block body a distance less than the depth of the block body;

providing a plurality of block connectors having upper, intermediate and lower portions, the upper portions being sized to be received within the indentation in the rear face of the wall block, the intermediate portions extending between the upper and lower portions and having a length at least as great as a distance between the indentation in the rear face of the wall block and the bottom planar surface of the wall block, the lower portion being sized to extend below the bottom planar surface of the wall block when the upper portion is received in the indentation;

positioning a first plurality of the wall blocks to form at least a portion of a lower course of the wall;

attaching at least one connector to each of a second plurality of wall blocks such that the upper portion of the at least one connector is received in the indentation in the rear face of the wall block, the intermediate portion of the connector extends along the rear face of the wall block between the indentation and a bottom surface of the wall block, and the lower portion of the connector extends below the bottom surface of the wall block; and stacking the second plurality of wall blocks on the first plurality of wall blocks to form at least a portion of an upper course of the wall, the lower portion of the at least one connector attached to each of the second plurality of wall blocks abutting a rear face of at least one of the blocks in the lower course to thereby prevent forward movement of the second plurality of wall blocks with respect to the lower course of the wall, wherein the upper portion of the block connectors include a first member extending from the intermediate portion in a first direction and a second member extending from the intermediate portion in a second direction different from the first direction, the first and second members each being sized to be received and retained within the at least one indentation, and wherein the lower portion of the block connectors include a projection extending from the intermediate portion in the first direction, the block connector being positioned in a first orientation when the first member is received within the at least one indentation and in a second orientation when the second member is received within the at least one indentation such that the upper course of blocks is setback from the lower course of blocks by a distance equal to a length of the projection when the block connector is positioned in the first orientation and the upper course of blocks has a zero setback with respect to the lower course of blocks when the block connector is positioned in the second orientation.

* * * * *